US005678908A

United States Patent [19]

Wang

[11] Patent Number: 5,678,908

[45] Date of Patent: Oct. 21, 1997

[54] JEWELRY CASE

[76] Inventor: Chen-Yuan Wang, No. 50, Sec. 5, An-Ho Rd., An-Nan Dist., Tainan City, Taiwan

[21] Appl. No.: 590,889

[22] Filed: Jan. 24, 1996

[51] Int. Cl.[6] ..... A47B 47/04

[52] U.S. Cl. ..... 312/264; 312/122; 312/285; 312/249.4

[58] Field of Search ..... 312/117, 119, 312/122, 264, 265.5, 285, 249.2, 249.4; 206/6.1

[56] References Cited

U.S. PATENT DOCUMENTS

| | | | |
|---|---|---|---|
| 4,270,820 | 6/1981 | McMullan et al. | 312/265.5 X |
| 4,356,531 | 10/1982 | Marino et al. | 312/265.5 X |
| 5,259,668 | 11/1993 | Teufel et al. | 312/265.5 X |

FOREIGN PATENT DOCUMENTS

| | | | |
|---|---|---|---|
| 26212 | of 1904 | United Kingdom | 312/249.4 |

*Primary Examiner*—Peter M. Cuomo
*Assistant Examiner*—David E. Allred
*Attorney, Agent, or Firm*—Brinks Hofer Gilson & Lione

[57] ABSTRACT

A jewelry case includes a base, a pair of drawer supports, a top cover and at least one drawer. The base has a top side formed with two sets of first positioning units. Each of the drawer supports includes an upright support plate having a bottom end formed with a set of second positioning units for engaging a respective one of the two sets of first positioning units. The drawer supports are mounted onto the base with the use of screws. The top cover has a bottom side formed with two sets of positioning sockets which are aligned respectively with lugs on the drawer supports, and two sets of aligned clamping plates. Each of the sets of clamping plates cooperates with a respective one of the sets of positioning sockets to form a clearance for clamping one edge of a respective one of the drawer supports therein. The top cover is mounted onto the drawer supports with the use of screws. Each drawer extends between the drawer supports and is retained slidably therebetween by horizontal guide rails.

12 Claims, 5 Drawing Sheets

JEWELRY CASE

BACKGROUND OF THE INVENTION

1. Field of the Invention

The invention relates to a jewelry case, more particularly to a jewelry case which is easy to assemble.

2. Description of the Related Art

Jewelry cases are designed to store small articles therein. Usually, jewelry cases are provided with drawers for receiving earrings and necklaces. Jewelry cases are conventionally assembled by attaching adhesively small pieces of plates to form the case body and the drawers therefor. Thus, assembly of the conventional jewelry cases is troublesome, time consuming and entails a relatively high manufacturing cost.

SUMMARY OF THE INVENTION

Therefore, the object of the present invention is to provide a jewelry case which is easy to assemble, thereby overcoming the drawbacks that are commonly associated with the prior art.

Accordingly, the jewelry case of the present invention comprises:

a base having a top side formed with two sets of first positioning units and two sets of positioning holes;

a pair of drawer supports, each of which includes an upright support plate having an inner side formed with horizontal guide means, the support plate further having a bottom end formed with a set of second positioning units for engaging a respective one of the two sets of first positioning units and a set of fastener holes aligned with a respective one of the two sets of positioning holes, the support plate further having a top end formed with a set of lugs;

first screws extending through the positioning holes in the base and engaging the fastener holes in the drawer supports to mount the drawer supports onto the base;

a top cover having a bottom side formed with two sets of positioning sockets which are aligned respectively with the lugs on the drawer supports, and two sets of aligned clamping plates, each of the sets of clamping plates cooperating with a respective one of the sets of positioning sockets to form a clearance for clamping one edge of a respective one of the drawer supports therein;

second screws extending through the lugs on the drawer supports and engaging the positioning sockets of the top cover to mount the top cover onto the drawer supports; and at least one drawer extending between the drawer supports and retained slidably therebetween by the guide means.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
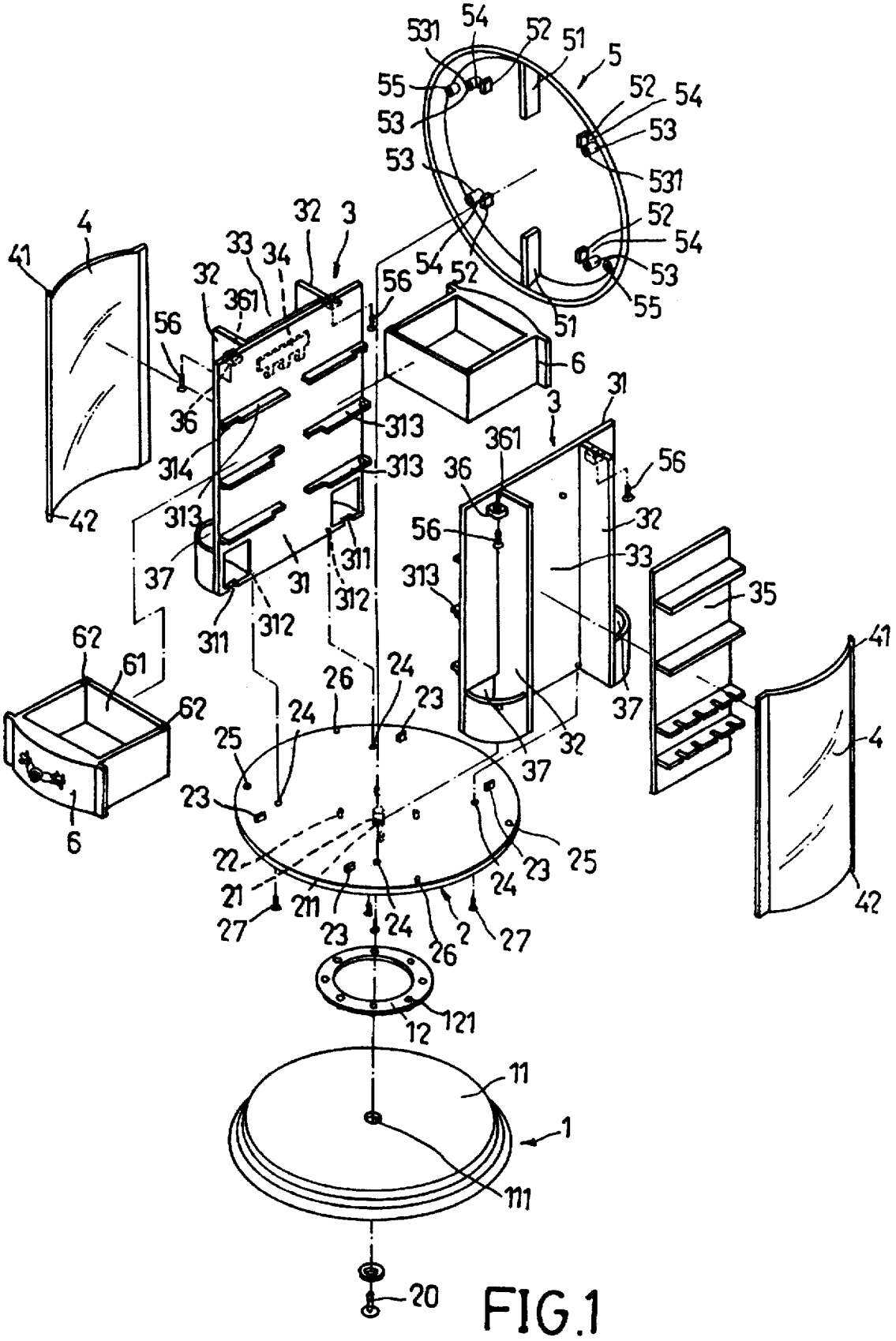
FIG. 1 is an exploded view of the first preferred embodiment of a jewelry case according to the present invention.
Figure 2:
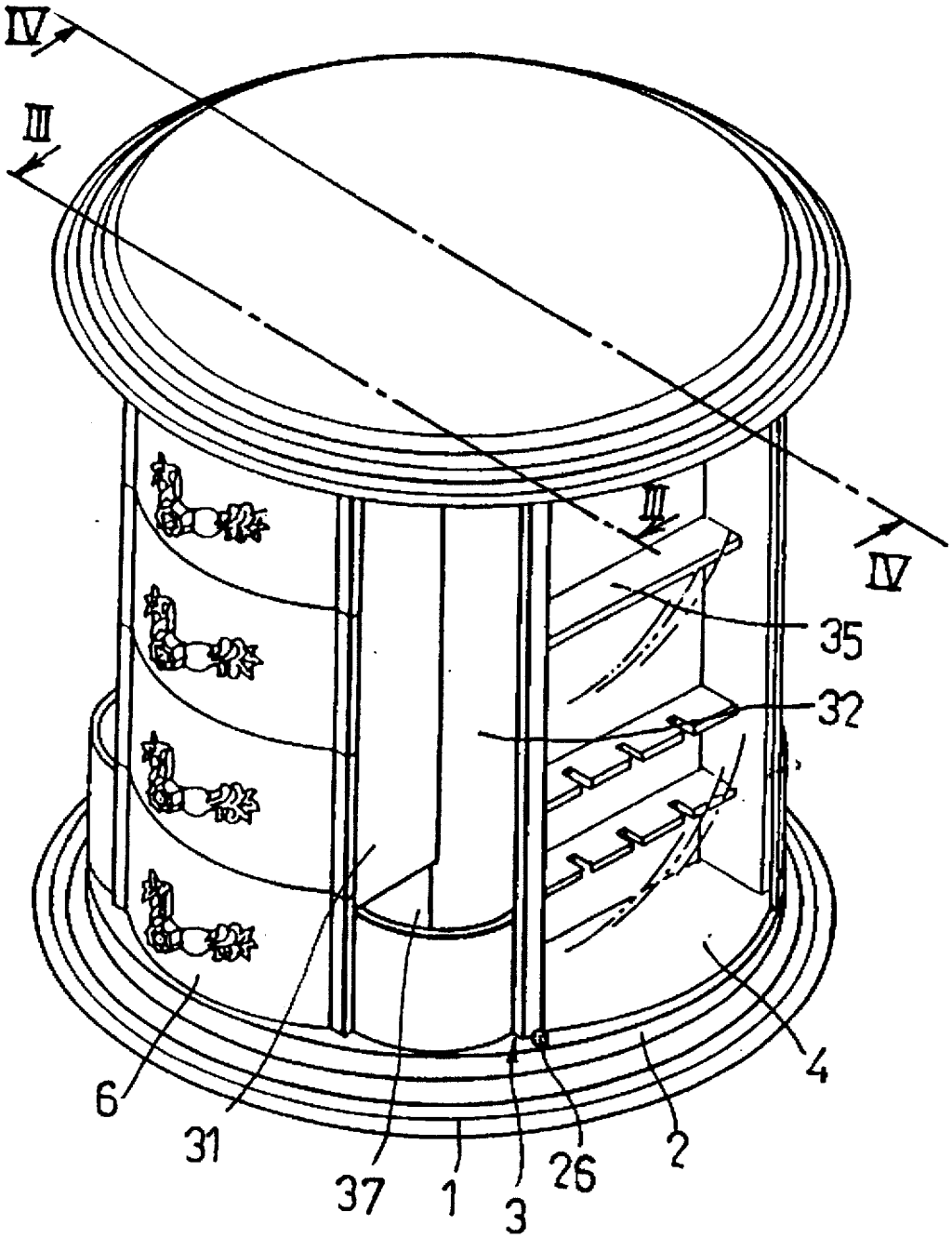
FIG. 2 is a perspective view of the first preferred embodiment.
Figure 3:
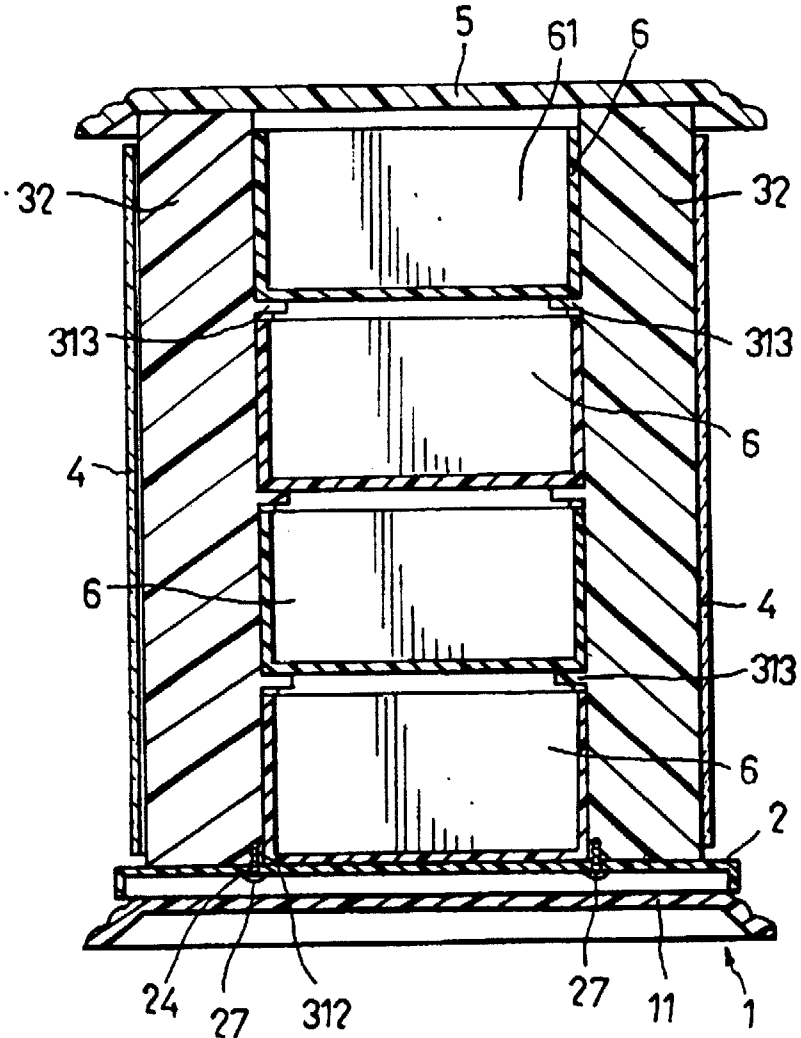
FIG. 3 is a sectional view of the first preferred embodiment, taken along line III—III in FIG. 2.
Figure 4:
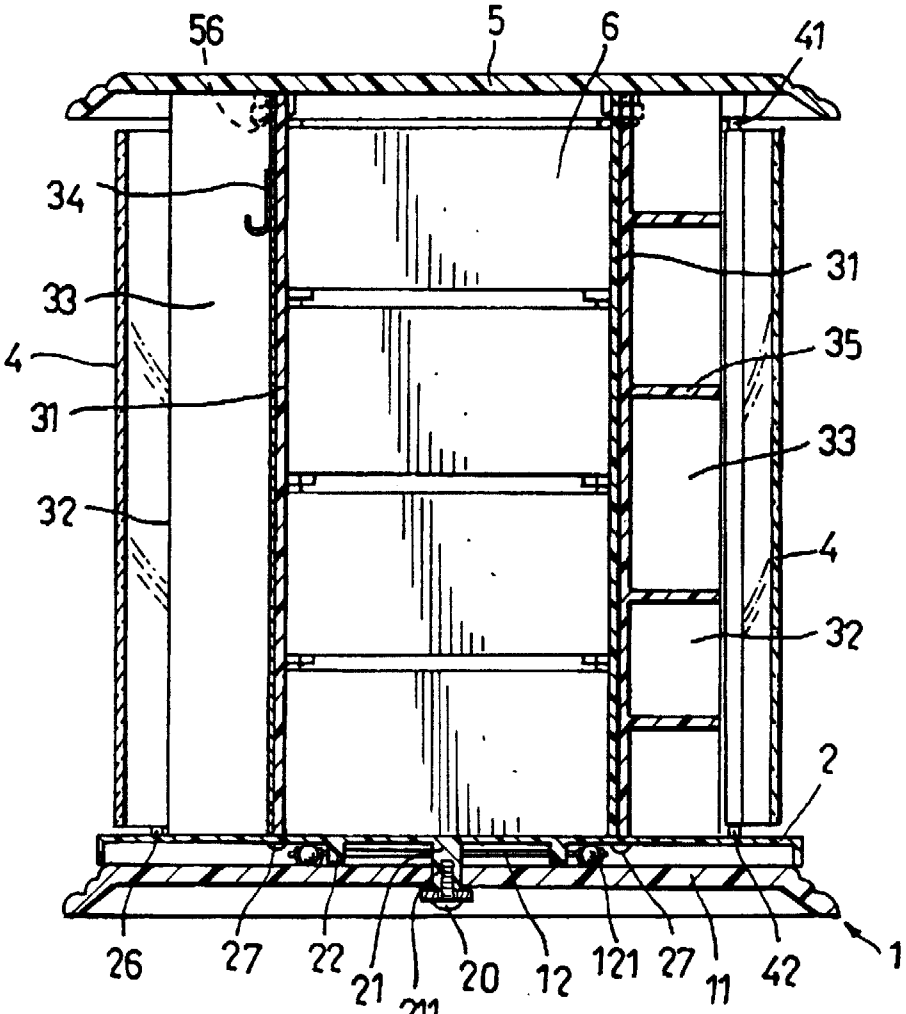
FIG. 4 is another sectional view of the first preferred embodiment, taken along line IV—IV in FIG. 2.

Before the present invention is described in greater detail, it should be noted that like elements are denoted by the same reference numerals throughout the disclosure.

Referring to FIGS. 1 to 4, the first preferred embodiment of jewelry case according to the present invention is shown to comprise a rotary support 1, a base 2, a pair of drawer supports 3, a pair of door panels 4, a top cover 5 and a plurality of drawers 6.

The rotary support 1 includes a circular stationary plate 11 and an annular ball bearing seat 12. The stationary plate 11 is formed with a central hole 111. The ball bearing seat 12 is disposed on top of the stationary plate 11 and is concentric with the central hole 111. The ball bearing seat 12 has a plurality of ball bearings 121 disposed thereon.

The base 2 has a shape which complements that of the stationary plate 11. The bottom side of the base 2 is formed with a downwardly extending shaft 21 which extends into the central hole 111. The shaft 21 is formed with an axial screw hole 211 for engaging a screw 20, thereby securing the base 2 onto the rotary support 1. The bottom side of the base 2 is further provided with a plurality of downwardly extending positioning pins 22 around the shaft 21 for positioning the ball bearing seat 12 between the base 2 and the stationary plate 11. The base 2 has a top side formed with two sets of first positioning units, such as aligned positioning studs 23, and two sets of positioning holes 24. The base 2 further has a peripheral portion formed with diametrically opposite pairs of lower retaining holes 25 and door stopping projections 26.

The drawer supports 3 are identical in construction and are to be disposed on the base 2. Each of the drawer supports 3 includes an upright support plate 31 having an inner side formed with six horizontal guide rails 313. Each of the guide rails 313 has a distal end formed with a limit projection 314. The support plate 31 further has a bottom end formed with a set of second positioning units, such as positioning grooves 311, for engaging a respective set of positioning studs 23 on the base 2, and a set of fastener holes 312 aligned with a respective set of positioning holes 24 in the base 2. The support plate 31 further has an outer side formed with a parallel pair of vertical partitions 32 which confine a receiving space 33 therebetween. The receiving space 33 of one of the support plates 31 is provided with a hook unit 34 for hanging necklaces (not shown) thereon. The receiving space 33 of the other one of the support plates 31 is provided with an earring support unit 35 for placing or hanging earrings (not shown) thereon. Each of the support plates 31 further has a top end formed with lugs 36 on two sides of the vertical partitions 32. Each of the lugs 36 has a pin hole 361 formed therethrough. The bottom end of each of the support plates 31 is further formed with compartments 37 on two sides of the vertical partitions 32 for receiving make-up applicators or lipsticks (not shown) therein.

Each of the door panels 4 is formed as a transparent curved plate having top and bottom ends provided with upper and lower pins 41, 42. The lower pin 42 extends into a respective one of the retaining holes 25 in the base 2.

The top cover 5 is to be disposed on top of the drawer supports 3 and has a bottom side formed with a pair of dividers 51 that are parallel to the drawer supports 3. The bottom side of the top cover 5 is further formed with two sets of positioning sockets 53 which are aligned respectively with the lugs 36 on the support plates 31, and two sets of aligned clamping plates 52. The clamping plates 52 cooperate with the positioning sockets 53 to form clearances 54 for clamping one edge of the drawer supports 3. Each of the positioning sockets 53 is formed with an axial retaining hole 531 which is aligned with the pin hole 361 in a respective one of the lugs 36. The bottom side of the top cover 5 is further formed with a pair of upper retaining holes 55 which are aligned with the lower retaining holes 25 in the base 2.

The drawers 6 extend between the drawer supports 3 and are retained slidably therebetween by the guide rails 313. Each of the drawers 6 confines a space 61 and has a rear end formed with a pair of limit projections 62 that are aligned with the limit projections 314 on the guide rails 313. When the drawers 6 are disposed between the drawer supports 3, the limit projections 62 abut against the limit projections 314 to prevent removal of the drawers 6 from the drawer supports 3.

Prior to assembly of the jewelry case, the stationary plate 11, the base 2, the drawer supports 3, the door panels 4, the top cover 5 and the drawers 6 are formed integrally beforehand. During assembly, the top cover 5 is initially disposed in an inverted position. The drawer supports 3 are installed on the top cover 5 such that the top edges of the former extend into the clearances 54 in the latter. The pin holes 361 in the lugs 36 are aligned with the retaining holes 531 in the positioning sockets 53 at this time. Screws 56 extend through the aligned holes 361, 531 to secure the drawer supports 3 onto the top cover 5. The hook unit 34 and the earring support unit 35 are then installed in the receiving space 33 of the respective drawer support 3. The door panels 4 are used to cover the receiving spaces 33 and are installed by extending the upper pins 41 of the door panels 4 into the upper retaining holes 55 in the top cover 5. The base 2 is mounted to bottom ends of the drawer supports 3. To install the base 2, the positioning studs 23 on the base 2 are received within the positioning grooves 311 in the drawer supports 3, and the positioning holes 24 in the base 2 are aligned with the fastener holes 312 in the drawer supports 3. Screws 27 extend into the aligned holes 24, 312 to secure the base 2 onto the drawer supports 3. At the same time, the lower pins 42 on the door panels 4 extend into the lower retaining holes 25 in the base 2. Thus, the door panels 4 are retained pivotally between the top cover 5 and the base 2. The door stopping projections 26 retain releasably the door panels 4 in a closed position in a known manner. The ball bearing seat 12 is then disposed on the bottom side of the base 2 and is covered by the stationary plate 11. The shaft 21 of the base 2 extends into the central hole 111 in the stationary plate 11, and the screw 20 engages the screw hole 211 in the shaft 21 to mount the rotary support 1 onto the base 2. Finally, the drawers 6 are extended between the drawer supports 3 so as to be retained slidably therebetween by the guide rails 313. Assembly of the jewelry case is completed at this time.

Referring again to FIGS. 2 and 4, in use, small articles (not shown) can be placed in the drawers 6, necklaces (not shown) can be hung on the hook unit 34, earrings (not shown) can be placed or hung on the earring support unit 35, and make-up applicators or lipsticks (not shown) can be placed in the compartments 37. The ball bearings 121, which are disposed on the ball bearing seat 12 between the rotary support 1 and the base 2, permit rotation of the portion of the jewelry case above the base 2, thereby facilitating access to the drawers 6 and the receiving spaces 33.

Figure 5:
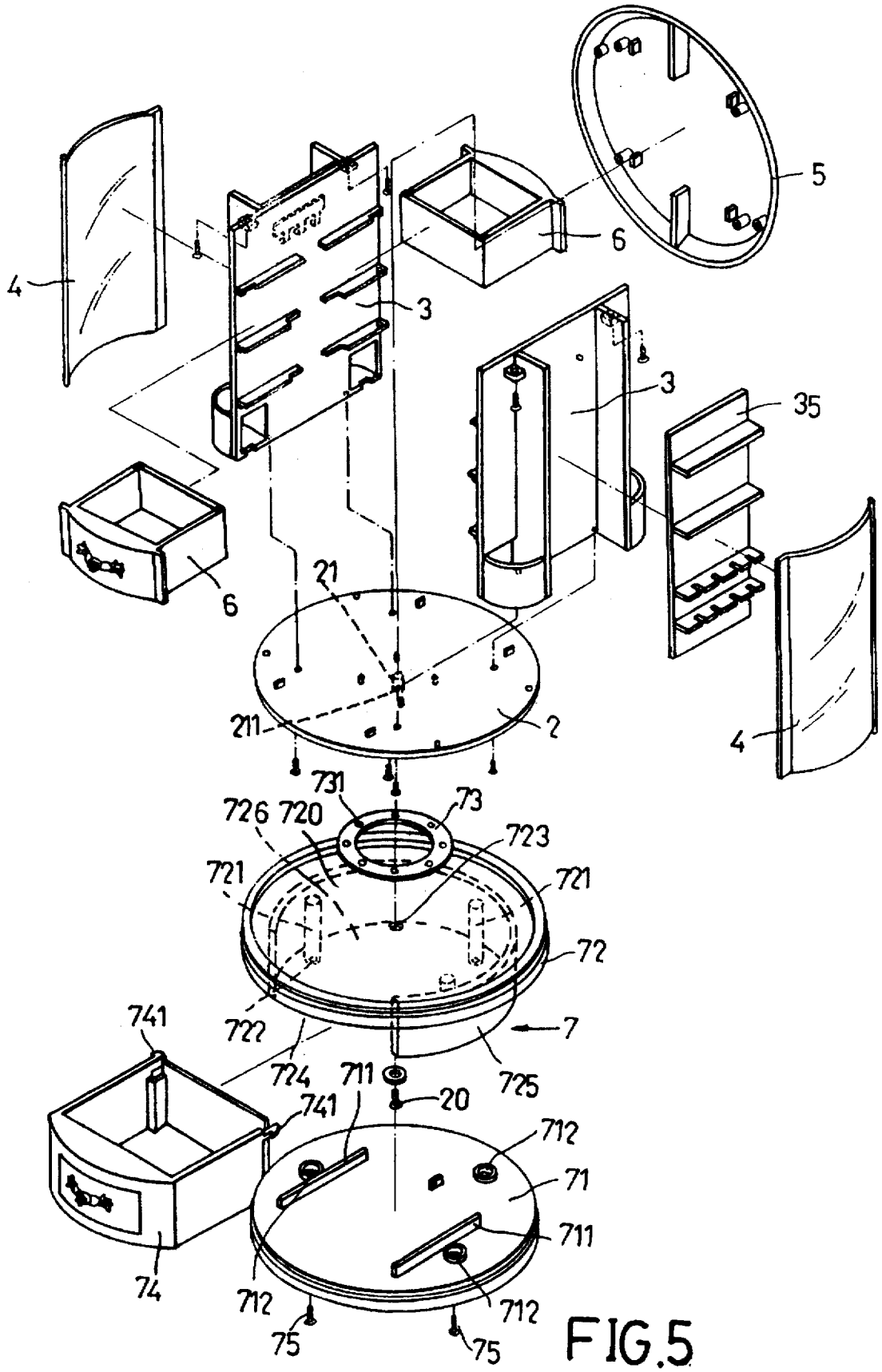
FIG. 5 is an exploded view of the second preferred embodiment of a jewelry case according to the present invention.

The second preferred embodiment of a jewelry case according to the present invention is shown in FIG. 5. Unlike the first preferred embodiment, the rotary support 7 not only serves to support rotatably the base 2 but is further provided with an additional drawer 74 to increase the storage capacity of the jewelry case. As shown, the rotary support 7 includes a stationary plate 71, a drawer housing 72, an annular ball bearing seat 73 and the drawer 74.

The stationary plate 71 has a top side formed with a spaced pair of parallel guide rails 711 and a plurality of mounting sockets 712 along a peripheral portion thereof. The drawer housing 72 is to be disposed on top of the stationary plate 71 and includes a top plate 720 which is formed with a plurality of mounting posts 721 that extend respectively into the mounting sockets 712. Each of the mounting posts 721 has a bottom end formed with an axial screw hole 722. Screws 75 extend through the mounting sockets 712 and engage the screw holes 722, thereby mounting the drawer housing 72 onto the stationary plate 71. The top plate 720 is formed with a central hole 723. The ball bearing seat 73 is disposed on the top plate 720 and is concentric with the central hole 723. The ball bearing seat 73 has a plurality of ball bearings 731 disposed thereon. The shaft 21 of the base 2 extends into the central hole 723, and the screw 20 engages the screw hole 211 in the shaft 21 to secure the base 2 onto the rotary support 7.

In order to increase the storage capacity of the jewelry case, the drawer housing 72 further includes a surrounding wall 725 which extends downwardly from the top plate 720 and which cooperates with the stationary plate 71 to confine a drawer receiving space 726. The surrounding wall 725 is formed with a cut-out 724 that has a width corresponding to the distance between the guide rails 711. The drawer 74 extends into the receiving space 726 via the cut-out 724 and is received slidably between the guide rails 711. The drawer 74 has a rear end which is provided with limit projections, such as hooks 741, to prevent removal of the drawer 74 from the drawer receiving space 726.

A music generating device (not shown) may be installed in the drawer receiving space 726 so that music can be generated when the drawer 74 is opened. The structure of the music generating device is known in the art and will not be detailed further.

It should be noted that, in order to accomplish the object of the present invention, there is only a need to provide the drawer supports on the base, and the top cover on the drawer supports. The rotary support only provides added convenience to the jewelry case of the present invention. Likewise, the presence of the door panels and the limit projections on the drawers and on the guide rails should not be deemed critical to the present invention.

It has thus been shown that the jewelry case of the present invention is convenient to assemble as compared to the prior art. The object of the present invention is thus met.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A jewelry case comprising:

a base having a top side formed with two sets of first positioning units and two sets of positioning holes;

a pair of drawer supports, each of which includes an upright support plate having an inner side formed with horizontal guide means, said support plate further having a bottom end formed with a set of second positioning units for engaging a respective one of said two sets of first positioning units and a set of fastener holes aligned with a respective one of said two sets of positioning holes, said support plate further having a top end formed with a set of lugs;

first screws extending through said positioning holes in said base and engaging said fastener holes in said drawer supports to mount said drawer supports onto said base;

a top cover having a bottom side formed with two sets of positioning sockets which are aligned respectively with said lugs on said drawer supports, and two sets of aligned clamping plates, each of said sets of clamping plates cooperating with a respective one of said sets of positioning sockets forming a clearance which receives and clamps one edge of a respective one of said drawer supports therein;

second screws extending through said lugs on said drawer supports and engaging said positioning sockets of said top cover to mount said top cover onto said drawer supports; and at least one drawer extending between said drawer supports and retained slidably therebetween by said guide means.

2. The jewelry case as claimed in claim 1, wherein said first positioning units are studs, and said second positioning units are grooves which engage said studs.

3. The jewelry case as claimed in claim 1, further comprising a rotary support for supporting rotatably said base thereon.

4. The jewelry case as claimed in claim 3, wherein said rotary support includes a stationary plate formed with a central hole, and an annular ball bearing seat disposed between said stationary plate and said base and concentric with said central hole, said ball bearing seat having a plurality of ball bearings disposed thereon, said base having a bottom side which is formed with a downwardly extending shaft that extends into said central hole, said jewelry case further comprising a third screw which engages said shaft to secure said base onto said stationary plate.

5. The jewelry case as claimed in claim 4, wherein said bottom side of said base is further provided with a plurality of downwardly extending positioning pins around said shaft for positioning said ball bearing seat between said base and said stationary plate.

6. The jewelry case as claimed in claim 1, wherein each of said guide means has a distal end formed with a first limit projection, said drawer being provided with a pair of second limit projections that are aligned with said first limit projection on said guide means, said first and second limit projections preventing removal of said drawer from said drawer supports when said drawer is disposed between said drawer supports.

7. The jewelry case as claimed in claim 1, wherein said support plate of each of said drawer supports further has an outer side formed with a parallel pair of vertical partitions which confine a receiving space therebetween.

8. The jewelry case as claimed in claim 7, wherein said receiving space of one of said drawer supports is provided with a hook unit for hanging necklaces thereon.

9. The jewelry case as claimed in claim 7, wherein said receiving space of one of said drawer supports is provided with an earring support unit for placing or hanging earrings thereon.

10. The jewelry case as claimed in claim 1, wherein said top side of said base is formed with two lower retaining holes, each being disposed adjacent to one of said vertical partitions of a respective one of said drawer supports, said bottom side of said top cover being formed with two upper retaining holes which are aligned with said lower retaining holes, said jewelry case further comprising a pair of door panels for covering said receiving space of said drawer supports, each of said door panels having top and bottom ends provided with upper and lower pivot pins that extend into a respective one of said lower and upper retaining holes.

11. The jewelry case as claimed in claim 3, wherein said rotary support includes a stationary plate having a top side formed with a spaced pair of parallel guide rails, and a drawer housing mounted on top of said stationary plate, said drawer housing including a top plate and a surrounding wall which extends downwardly from said top plate and which cooperates with said stationary plate to confine a drawer receiving space, said surrounding wall being formed with a cut-out that has a width corresponding to the distance between said guide rails, said rotary support further including a second drawer which extends into said receiving space via said cut-out and which is received slidably between said guide rails, said top plate of said drawer housing being formed with a central hole, said rotary support further including an annular ball bearing seat disposed between said stationary plate and said base and concentric with said central hole, said ball bearing seat having a plurality of ball bearings disposed thereon, said base having a bottom side which is formed with a downwardly extending shaft that extends into said central hole, said jewelry case further comprising a third screw which engages said shaft to secure said base onto said drawer housing.

12. The jewelry case as claimed in claim 11, wherein said top side of said stationary plate further has a plurality of mounting sockets along a peripheral portion thereof, said top plate of said drawer housing being formed with a plurality of mounting posts that extend respectively into said mounting sockets, said rotary support further comprising screws which extend through said mounting sockets and which engage said mounting posts to mount said drawer housing onto said stationary plate.

* * * * *